US011297927B1

(12) United States Patent
Johnson

(10) Patent No.: US 11,297,927 B1
(45) Date of Patent: Apr. 12, 2022

(54) HUMIDOR BACKPACK

(71) Applicant: Byron Johnson, Miami Gardens, FL (US)

(72) Inventor: Byron Johnson, Miami Gardens, FL (US)

( * ) Notice: Subject to any disclaimer, the term of this patent is extended or adjusted under 35 U.S.C. 154(b) by 0 days.

(21) Appl. No.: 17/499,787

(22) Filed: Oct. 12, 2021

(51) Int. Cl.

| | |
|---|---|
| ***A45F 3/02*** | (2006.01) |
| ***A45C 13/10*** | (2006.01) |
| ***B65D 81/18*** | (2006.01) |
| *A45F 3/00* | (2006.01) |

(52) U.S. Cl.
CPC ..... *A45F 3/02* (2013.01); *A45C 13/103* (2013.01); *B65D 81/18* (2013.01); *A45F 2003/001* (2013.01); *A45F 2200/0566* (2013.01)

(58) Field of Classification Search
CPC .... A45F 3/02; A45F 3/047; A45F 3/04; A45F 2003/003; A45C 13/02; A24F 25/02
See application file for complete search history.

(56) References Cited

U.S. PATENT DOCUMENTS

| | | | | | |
|---|---|---|---|---|---|
| 4,609,084 | A * | 9/1986 | Thomas | A45C 9/00 | 190/110 |
| 4,925,064 | A * | 5/1990 | Comora | A45F 3/04 | 224/155 |
| 5,447,261 | A * | 9/1995 | Mitomi | A45C 5/14 | 190/110 |
| D379,267 | S * | 5/1997 | Roegner | D3/285 | |
| D380,612 | S * | 7/1997 | Kelley | D3/276 | |
| 5,803,247 | A * | 9/1998 | Holmes | A24F 25/02 | 206/213.1 |
| 5,829,452 | A * | 11/1998 | Oster | A24F 25/02 | 131/250 |
| 5,884,768 | A * | 3/1999 | Fox | A45C 13/36 | 206/522 |
| 5,957,354 | A * | 9/1999 | Mentken | A45F 3/04 | 224/614 |
| 6,474,524 | B1 * | 11/2002 | Ivarson | A45F 3/04 | 224/637 |
| 7,165,705 | B2 * | 1/2007 | Haro | A45C 13/04 | 224/627 |
| 9,320,341 | B2 * | 4/2016 | Majeau | A45F 3/04 | |
| 10,413,045 | B2 * | 9/2019 | Crisp | A45F 3/04 | |
| 2004/0145202 | A1 * | 7/2004 | Dela Paz | A45F 3/14 | 294/157 |
| 2006/0027482 | A1 * | 2/2006 | Pearson | B65H 75/362 | 206/702 |

(Continued)

OTHER PUBLICATIONS

Fu G et al., Multi-functional knapsack, has storage bag body comprising upper pocket, middle layer bag body provided with chip, lower bag body provided with temperature meter and humidity gauge, and double-shoulder belt provided with music player, Dec. 2016, Derwent. (Year: 2016).*

*Primary Examiner* — Brian D Nash
(74) *Attorney, Agent, or Firm* — Christopher J. Vandam, PA; Chris Van Dam

(57) ABSTRACT

A backpack for transporting cigars in a humidity controlled environment that also includes cigar and lifestyle accessories. The humidity of the entire contents of the backpack are measured by a hydrometer visible from outside the backpack. A smaller removable case is also provided inside the backpack allowing essentials to be transported outside of the backpack.

4 Claims, 6 Drawing Sheets

(56) References Cited

U.S. PATENT DOCUMENTS

| | | | | |
|---|---|---|---|---|
| 2007/0056779 | A1* | 3/2007 | Laniado | E04H 4/06 177/245 |
| 2008/0053864 | A1* | 3/2008 | Nonas | A45C 11/20 206/549 |
| 2008/0083802 | A1* | 4/2008 | Reziniano | A45F 3/04 224/576 |
| 2009/0184143 | A1* | 7/2009 | Witt | A45C 7/0086 224/153 |
| 2010/0282809 | A1* | 11/2010 | Scicluna | A45C 13/02 224/653 |
| 2019/0185243 | A1* | 6/2019 | Kuhlman | B65D 81/264 |
| 2020/0037734 | A1* | 2/2020 | Ortlieb | A45F 3/12 |
| 2020/0077772 | A1* | 3/2020 | Maravilla | A45F 3/04 |

* cited by examiner

HUMIDOR BACKPACK

CROSS-REFERENCES TO RELATED APPLICATIONS

None.

STATEMENT REGARDING FEDERAL SPONSORED RESEARCH OR DEVELOPMENT

None.

NAMES OF PARTIES TO A JOINT RESEARCH AGREEMENT

None.

REFERENCE TO A "SEQUENCE LISTING", A TABLE, OR A COMPUTER PROGRAM LISTING APPENDIX SUBMITTED ON COMPACT DISC AND INCORPORATION-BY-REFERENCE OF THE MATERIAL ON THE COMPACT DISCLOSURE

None.

STATEMENT REGARDING PRIOR DISCLOSURES BY AN INVENTOR OR JOINT INVENTOR

None.

BACKGROUND OF THE INVENTION

1. Field of the Invention

The present invention relates to portable humidors, and more particularly, to an improved humidor backpack with integrated lifestyle accessories.

2. Description of Related Art Including Information Disclosed Under 37 CFR 1.97 and 37 CFR 1.98

Several designs for humidors have been designed in the past. None of them, however, include a lockable, backpack-style humidor that stands vertically and that contains internally: a flask, a cigar lighter, general storage, a trimmed tool and individual storage for a plurality of cigars, all enclosed in a humidity controlled case.

Applicant believes that the closest prior art reference corresponds to commonly available compact humidors. While these are capable of being portable, none include the plurality of lifestyle accessories and cigars that are all contained within the humidity controlled case.

Other prior art references describe related subject matter that provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

BRIEF SUMMARY OF THE INVENTION

It is one of the main objects of the present invention to provide a portable humidor with a humidity controlled interior containing cigar storage and a variety of cigar-lifestyle accessories.

It is another object of this invention to provide a complete cigar experience backpack that properly stores cigars, a cigar tool, a lighter, a flask and other cigar related storage.

It is still another object of the present invention to provide a portable humidor that stands vertically to display a hydrometer referencing the humidity of the entire contents of the case.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE SEVERAL VIEWS OF THE DRAWING

With the above and other related objects in view, the invention exists in the details of construction and combination of parts as will be more fully understood from the following description, when read in conjunction with the accompanying drawings in which.

DETAILED DESCRIPTION OF THE INVENTION

Figure 1:
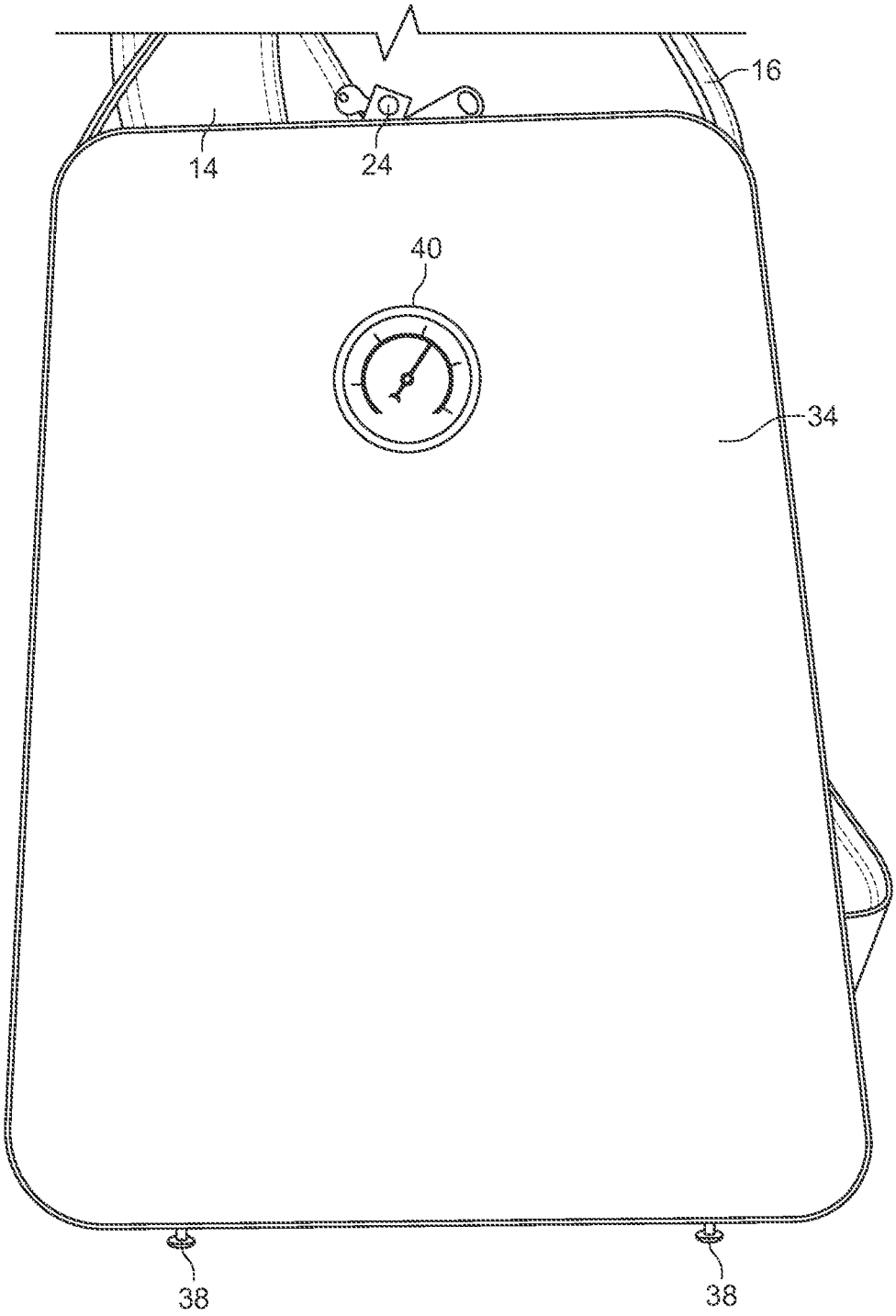
FIG. 1 shows a perspective view of a front side of a humidor backpack.
Figure 2:
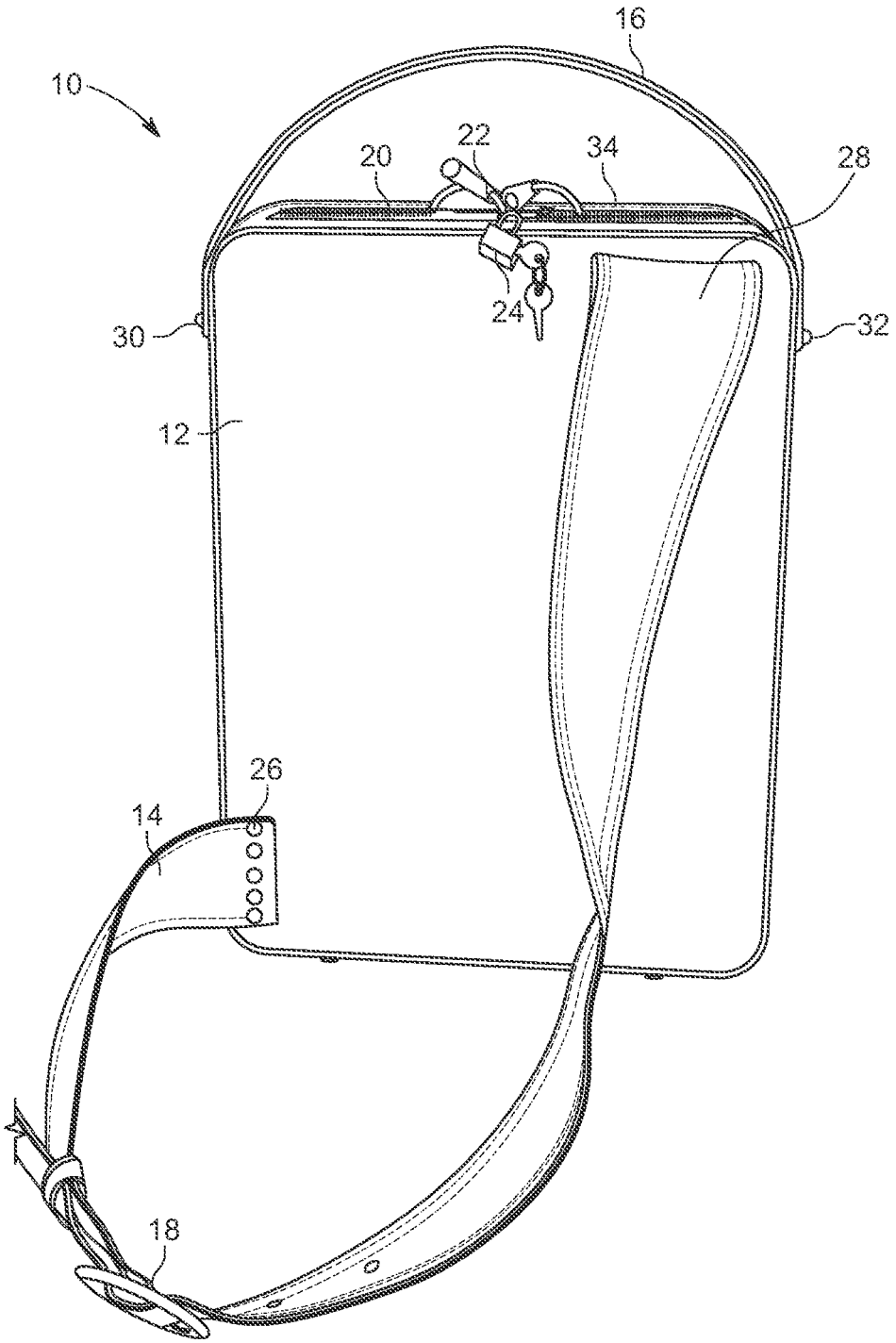
FIG. 2 shows a perspective view of a rear side of the humidor backpack.
Figure 3:
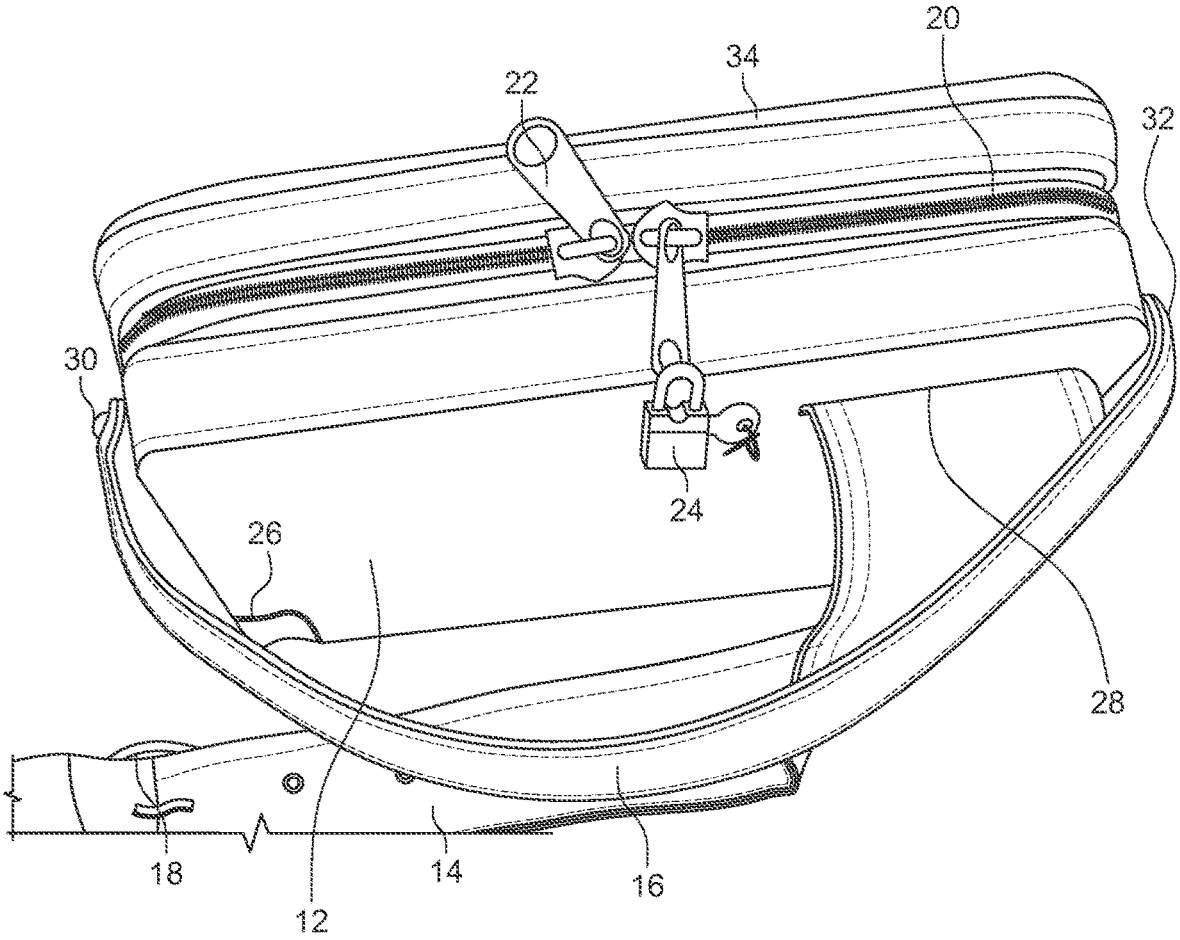
FIG. 3 shows a perspective view of a top side of the humidor backpack.
Figure 4:
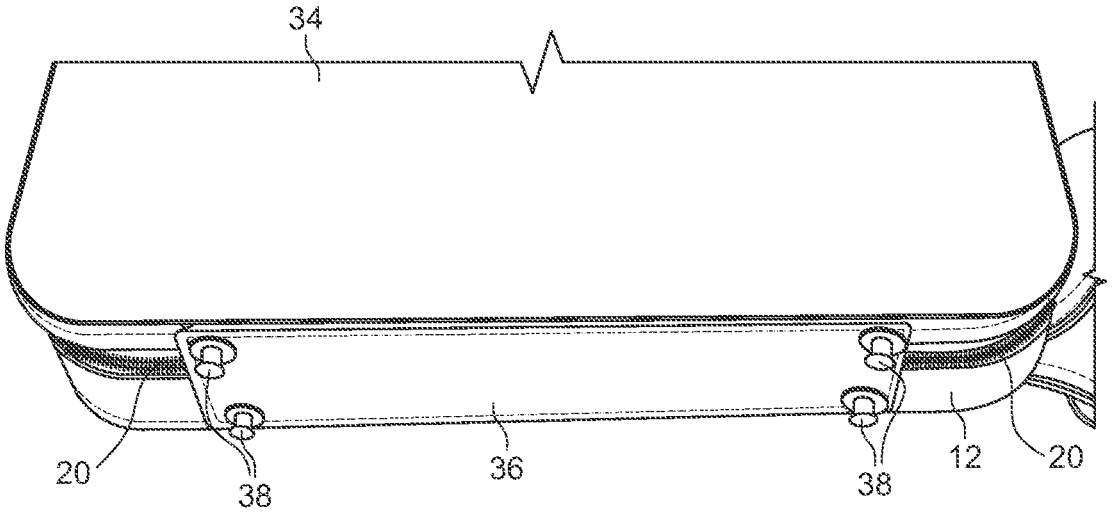
FIG. 4 shows a perspective view of a bottom side of the humidor backpack.

While this invention may be embodied in many different forms, there are described in detail herein specific embodiments of the invention. This description is exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device is sometimes referred to as the device, the invention, the humidor backpack, the humidor, the backpack, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes, among other shown and described features, a case back 12, a shoulder strap 14, a handle 16, a buckle 18, a zipper 20, a zipper handle 22, a lock 24, and attachment point 26, and attachment 28, a fastener 30, a fastener 32, a case front 34, a bottom panel 36, several feet 38, a hydrometer 40, a vent 42, a pouch 44, a flask 46, a pouch 48 a lighter 50, a pouch 52, a trim tool 54, several loops 56, a pocket 58, several cigars 60, two supports 62, a case 64, a latch 66, a strap 68, a pen 70, a pouch 74, a zipper 76, a zipper pull 78 and a lid 80.

Looking at the drawings, the humidor backpack is comprised of a case front 34 and a case back 12, each connected to the bottom panel 36. The case front 34 and case back 12 are each independently hinged along a bottom edge to the bottom panel 36.

The edges of the case front 34 and case back 12 are joined by a zipper 20. The zipper 20 is operable when opened and closed by use of the zipper handles 22. Optionally, a lock 24 may be provided to connect the zipper handles 22 together and prevent unauthorized opening of the humidor backpack.

The bottom panel 36 may include a plurality of feet 38. The feet are provided to protect the material of the bottom panel 36 and to raise the bottom panel 36 from the surface onto which the humidor backpack is placed. This can prevent damage to the bottom panel 36 and of the absorption of moisture into the bottom panel 36 that could ultimately affect the humidity inside the humidor.

The feet 38 may be fabricated from a hard material such as metal, plastic or any other durable material. The feet 38 are preferably positioned and spaced to stabilize the backpack humidor vertically when placed on a hard surface, such as a shelf, table or floor. The feet 38 generally define the bottom of the humidor backpack when the device is closed.

The case back 12 and case front 34 are generally sufficiently rigid to support the weight of the device and its contents when the humidor backpack is standing vertically on its feet 38. The case back 12 and case front 34 may be constructed out of a sandwich material with a decorative lamination, such as leather or other aesthetically pleasing material, on the visible surface.

The case back 12 and case front 34 may be molded from leather or other material treated to provide rigidity for the structure. There may be supportive elements affixed to the interior or exterior of the case back 12 and case front 34 to provide sufficient structural rigidity to prevent collapse of the humidor bag.

In one version of the device, the case back 12 and case front 34 are initially fabricated from a rigid shall of metal, wood, polymer or a combination. Then these structural elements are covered with a veneer of fine fabric, leather or other desirable material.

In an important embodiment of the humidor bag, a handle 16 is affixed at fastener 30 and at fastener 32. The handle 16 is generally flexible and durable and dimensioned to support the weight and contents of the humidor backpack. In at least one design, a variation of the handle 16 is affixed to a top edge of the case back 12 at fastener 30 and 32. This moves the handle 16 out of the way when opening the humidor backpack. The handle 16 may be easily grasped by the user of the humidor backpack to pick up the backpack.

A shoulder strap 14 is also preferably provided. The shoulder strap 14 at each end is connected to attachment point 26 and attachment point 28, respectively. Optionally, a buckle 18 may bisect the shoulder strap 14 and provides a means to shorten or lengthen the shoulder strap 14 to ensure a more comfortable fit to the shoulder of the user. The humidor may be easily transported by slinging the shoulder strap 14 over the shoulder of the user.

The handle 16 and shoulder strap 14 may be made of any flexible and durable material, such as, lather, fabric or other flexible and thin material suitable for use as a handle and shoulder strap. Leather is generally preferred for the handle 16 and shoulder strap 14 in order to lend a classic look. Both should be made of a durable, flexible and suitable material.

A hydrometer 40 is provided on the case front 34 with a gauge visible to the user on the exterior surface of the case front 34. The reverse of the hydrometer 40 is exposed to the interior of the humidor backpack. A vent 42 in the hydrometer 40 device permits the atmosphere inside the humidor backpack to be tested through the vent 42. This allows the hydrometer reading to be visible from the exterior of the case.

With the event 42 on the interior of the backpack, the humidity value of the entire content of the backpack is measured. Without opening a case, the user can ascertain the precise humidity value from the gauge on the exterior of the case front 34.

A humidity controlling device that can control the humidity chemically may be placed inside the case. This can automatically adjust the interior humidity to a predetermined value. For example, some commercially available humidor solutions contain propylene glycol based humidity control compositions. Other proprietary chemical blends are available in a variety of formats.

It has been found effective to use a humidity controlling device with propylene glycol in a format with similar dimensions to a cigar. One such device may be secured into one of the loops 56 on the case front 34 or in the pouch 74. Other styles of humidity controlling devices, such as satchel type devices, may be placed inside the backpack to both raise and lower the relative humidity to the appropriate value.

The case front 34 and case back 12 each hinge open about the bottom side adjacent to the bottom panel 36. Supports 62 may attach to a side edge on each the case back 12 and the supports 62 to limit how far the backpack can open. For example, the length of supports 62 may be dimensioned so that the case opens up slightly over ninety degrees. This allows the case to stay open when the case back 12 is placed on a horizontal surface and the case front 34 is opened to view and access the contents of the case.

Figure 5:
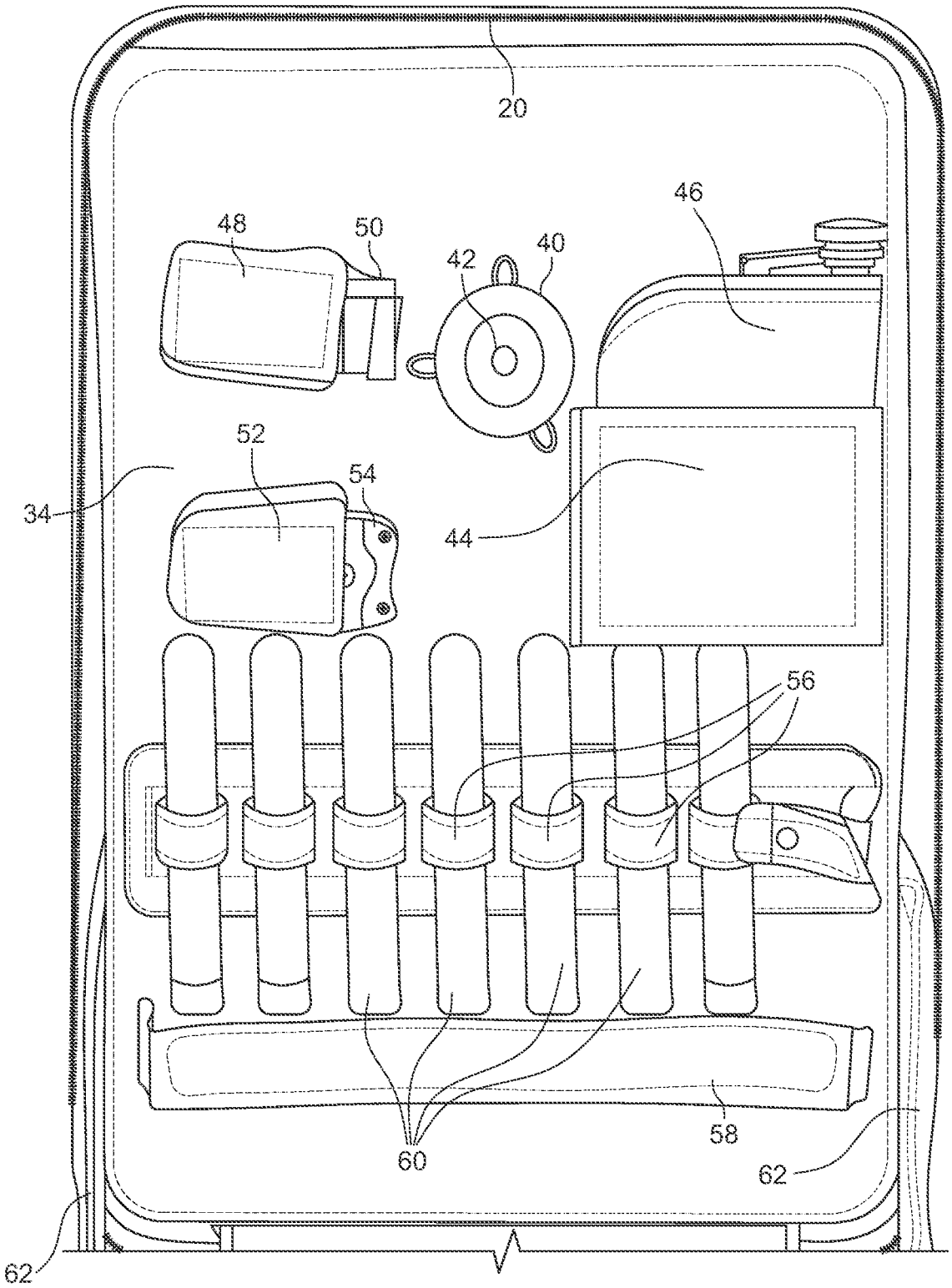
FIG. 5 shows a perspective view of an interior of the humidor backpack.
Figure 6:
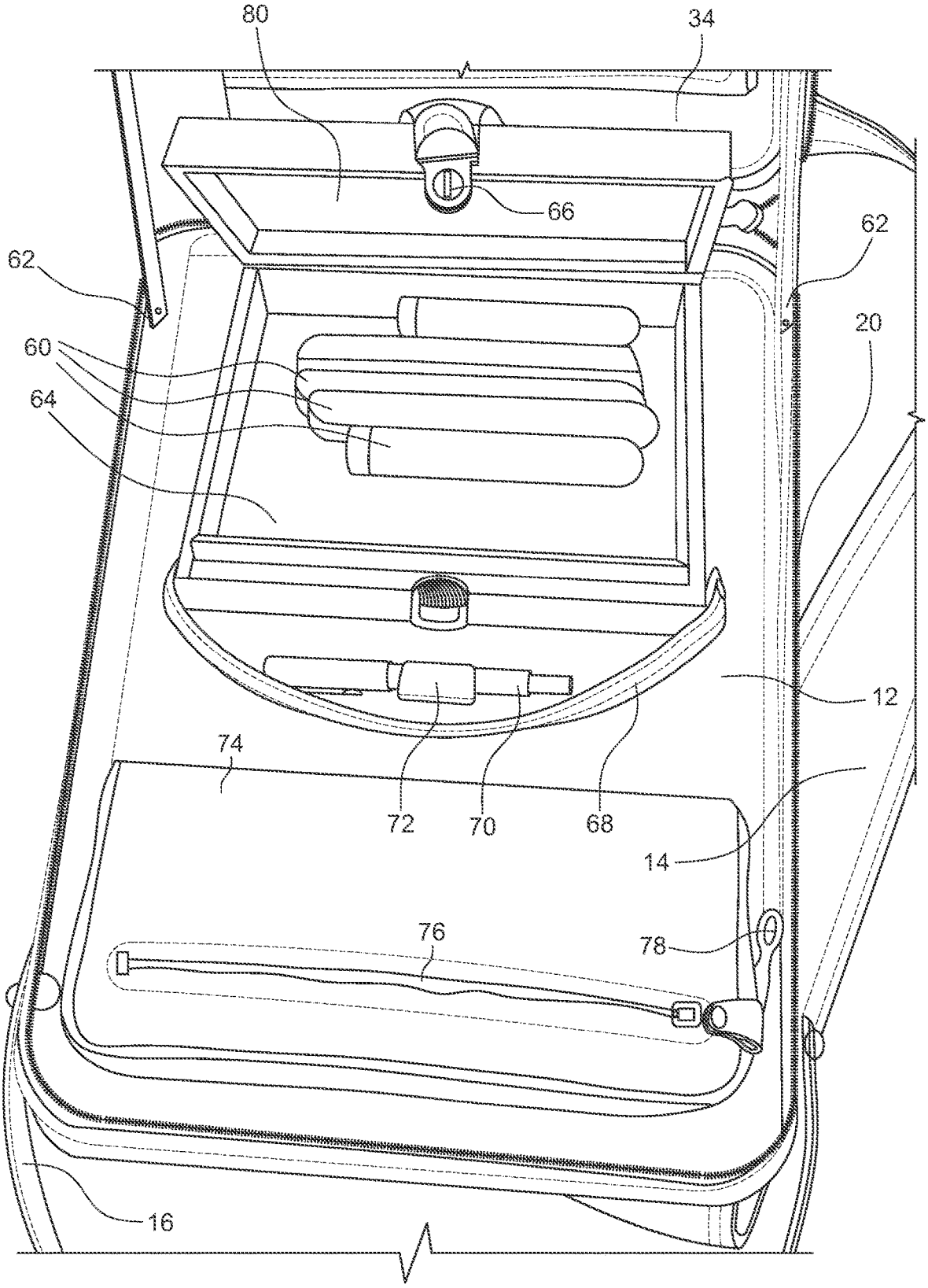
FIG. 6 shows a perspective view of an opposing interior of the humidor backpack.

On the interior surface of the case front 34 a variety of accessory storage is provided. An example is shown in FIG. 5 that includes a lighter 50, a flask 46, a trim tool 54, loops 56 and a pocket 58. It should be appreciated that different options, devices and positions may be provided as appropriate.

The lighter 50 may be attached to the interior of the case front 34 by providing a pouch 48, pocket, strap or other means of attaching the lighter 52 the interior of the case front 34. Similarly, a pouch 44 may hold the flask 46. Likewise, a pouch 52 may hold a trim tool 54. The nature of how the articles are affixed to the interior of the case is not critical to the inventive concept. Preferably, each of these articles are attached in some fashion to the interior of the case front 34 so that they remain in position and it can be readily removed for use.

The trim tool 54 may be characterized as any hardware that aids the user in the consumption of cigars. The trim tool 54 may include a cutter, a knife, a punch, a splitter or other similar tool that may be used to prepare and smoke cigars.

Cigar 60 storage is provided with a series of loops 56. The loops 56 are dimensioned to a particular gauge of cigar and may be adjusted by pulling the loops to fit different sizes of cigars. A pocket 58 may also be provided against which the cigars 60 can rest against to help ensure the cigars 60 remain in the loops 56.

On the interior surface of the case back 12 are other optional features. Additional cigar, tool or accessories storage may be provided by the case 64. The case 64 preferably includes a lid 80 and a latch 66. The latch 66 may also include a locking feature to secure the case 64 in a closed position.

The entirety of the case 64 is configured to be removed from the interior surface of the case back 12. Effectively this creates a portable miniature humidor that may be separated from the larger humidor backpack. This can be used to carry a smaller number of cigars and other equipment when the entire humidor backpack is not needed.

The case 64 may be affixed to the interior of the case back 12 by any removable attachment means, such as, hook and loop fasteners, magnets, clips, straps or other similar such means. A strap 68 may also be affixed to the case 64 to provide a simple means to carry the case 64 apart from the backpack assembly.

Optionally, a loop 72 adapted to hold a pen 70, or other writing instrument, is affixed to the interior surface of the case back 12. A pad of paper or other objects may be placed inside the pouch 74, also affixed to the interior of the case back 12. The pouch 74 may include a zipper 76 with complementary zipper pull 78.

In one version of the humidor backpack the pouch 74 surfaces are perforated or ventilated. With this feature, the humidity controlled device, as described above, may be placed inside the pouch 74. These apertures through the pouch 74 wall will allow humidity to flow in an out of the humidity controlled device contained within the pouch 74.

An important version of the humidor backpack can be fairly described as including a case back and a case front. The case back is affixed along a bottom edge to a bottom panel forming a hinge. The case front is affixed along a bottom edge to the bottom panel also forming a hinge. A zipper affixes to a perimeter of the case back to a matching perimeter of the case front to form an interior volume between the case back and case front. Each end of a handle is affixed to an upper edge of the case back to provide a convenient carrying means. Additionally, a shoulder strap is affixed to the case back at an upper edge at one end and a lower edge on a second end, forming a diagonal shoulder strap. A hydrometer fits through the case front so that the gauge side of the hydrometer is readable from the exterior of the case front and a vent is provided through the case front to measure the humidity of the air within the interior volume. In this way, the humidity of the entire interior volume, including the cigars and accessories, is constantly and conveniently measured. Affixed to the interior side of the case front are a variety of accessories, these may include any combination of a lighter, a flask, a trimmed tool and a series of cigar loops. Attached to an interior surface of the case back is a closeable pouch and a case. The case is attachable and removable from the interior surface of the case back 12 to provide a portable and smaller container for cigars and accessories when the entire humidor backpack is not needed, or would be inconvenient to bring along. Optionally, an exterior surface of the bottom panel may include several feet that are configured and adapted to support the humidor backpack in an operator vertical position when the zipper is closed and the device is in a storage mode. Also optional, a lock may be provided to secure the zipper in a closed position to avoid tampering with the contents of the humidor backpack.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

I claim:

1. A humidor backpack comprised of case back (12) and a case front (34);

the case back (12) is affixed along a bottom edge to a bottom panel (36);

the case front (34) is affixed along a bottom edge to the bottom panel (36);

a zipper (20) affixes a perimeter of the case back (12) to a corresponding perimeter of the case front (34);

a handle (16) at each of a first end and a second end is affixed to an upper edge of the case back (12);

a shoulder strap (14) at a first end is affixed to an upper edge of the case back (12) and at a second end is affixed to a bottom edge of the case back (12);

between the case back (12) and the case front (34) is formed an interior volume;

a hydrometer (40) is affixed to the case front (34) positioned so that a hydrometer gauge is visible from outside the case front (34);

the hydrometer (40) is configured to measure an air humidity within the entire interior volume;

affixed to an interior surface of the case front (34) are a lighter (50), a flask (46), a trim tool (54) and a plurality of cigar loops (56);

affixed to an interior surface of the case back (12) is a case (64) and a pouch (74);

the case (64) is selectively separable from the case back (12).

2. The humidor backpack of claim 1 further characterized in that an exterior surface of the bottom panel (36) has affixed a plurality of feet (38) that are configured to support the humidor backpack in a upright position when the zipper (20) is closed.

3. The humidor backpack of claim 2 further characterized in that a lock (24) is provided and configured to lock the zipper (20) in a closed position.

4. The humidor backpack of claim 1 further characterized in that a lock (24) is provided and configured to lock the zipper (20) in a closed position.

* * * * *